US005471933A

United States Patent [19]

Yoshino et al.

[11] Patent Number: 5,471,933

[45] Date of Patent: Dec. 5, 1995

[54] TRUCK WHEEL-SPACING CHANGING METHOD, AND VARIABLE WHEEL-SPACING TRUCK, AND GROUND FACILITY THEREFOR

[75] Inventors: Mitsuji Yoshino; Sunao Sugimoto; Noboru Kobayashi, all of Kobe, Japan

[73] Assignee: Kawasaki Jukogyo Kabushiki Kaisha, Kobe, Japan

[21] Appl. No.: 144,444

[22] Filed: Nov. 2, 1993

[30] Foreign Application Priority Data

Nov. 6, 1992 [JP] Japan ..... 4-322514

[51] Int. Cl.[6] ..... B61F 7/00

[52] U.S. Cl. ..... 104/33; 105/178

[58] Field of Search ..... 104/33; 105/178, 105/218.2

[56] References Cited

U.S. PATENT DOCUMENTS

| | | | |
|---|---|---|---|
| 105,984 | 8/1870 | Sanford | 104/33 |
| 3,403,637 | 10/1968 | Lich | 105/178 |

FOREIGN PATENT DOCUMENTS

| | | | |
|---|---|---|---|
| 244007 | 6/1910 | Germany | 104/33 |
| 727741 | 10/1942 | Germany | 104/33 |
| 1127386 | 4/1962 | Germany | 105/178 |
| 2738046 | 2/1978 | Germany . | |
| 2811502 | 9/1978 | Germany | 105/178 |
| 5447221 | 4/1979 | Japan . | |
| 45970 | 6/1962 | Poland | 105/178 |
| 18292 | 11/1911 | United Kingdom . | |
| 1173069 | 12/1969 | United Kingdom . | |

OTHER PUBLICATIONS

"Talco Trains on Two Gauges", The Railway Gazette, Feb. 21, 1969, pp. 136–142.

*Primary Examiner*—Robert J. Oberleitner
*Assistant Examiner*—S. Joseph Morano
*Attorney, Agent, or Firm*—Leydig, Voit & Mayer

[57] ABSTRACT

A variable wheel-spacing truck is equipped with axle boxes slidably mounted on axles extending between side beams of a bogie frame. Axle box receivers are selectively and releasably connected with the axle boxes at a plurality of predetermined positions by locking members. When the truck is moved from a first railway to a junction railway, auxiliary wheels mounted on the axle box receivers engage with running paths and raise the truck and a vehicle body except the wheel sets and release a locked condition by the locking members. When the truck is moved through a region where the track gauge of the junction railway is changing or where the spacings of inside or outside guide rails is changing, the wheels are pushed by a pair of guide rails or a pair of junction railway rails and shifted transversely together with the axle boxes relative to the axle.

22 Claims, 12 Drawing Sheets

TRUCK WHEEL-SPACING CHANGING METHOD, AND VARIABLE WHEEL-SPACING TRUCK, AND GROUND FACILITY THEREFOR

FIELD OF THE INVENTION

The present invention relates to a method for changing, in accordance with a change of a track gauge, i.e. a spacing between a pair of rails of a railway or track, a wheel-spacing (referred to hereafter also as "wheel gauge"), i.e. a spacing between left and right wheels of a truck supporting a vehicle body thereon so that the vehicle constituted by the vehicle body and the changeable or variable wheel-spacing truck can run on rails of different track gauges. Further, the invention relates to a variable wheel-spacing truck, namely, a truck having wheels of variable wheel-spacing, and to a ground facility therefor.

RELATED ARTS

In a general vehicle, the wheel-spacing or gauge of the truck supporting the vehicle body is always maintained constant according to the constant track gauge, and it is impossible for a vehicle to run from a railway of one track gauge onto another railway of a different track gauge. For example, in so-called "SHINKANSEN" line in Japan, a vehicle runs on a railway having a wider or standard track gauge, while in so-called "conventional line" in Japan, a vehicle runs only on a railway having a narrower track gauge.

There are several prior arts as follows:

① When intended to come from one onto another railway section where the track gauge is different, the track gauge in this section is reconstructed according to the wheel-spacing of the truck, thereby maintaining the wheel gauge, i.e. wheel-spacing, unchanged. This method is so called as "track gauge change".

② There is a variable wheel-spacing truck which is used in "TALGO TRAIN" in Spain. This truck comprises individually movable wheels, supported by wheel shafts, which are slidable in left and right directions relative to the bogie frame (frame of truck) and lock pins for determining the wheel-spacing, while the ground facility comprises truck-supporting rails and guide rails for guiding the wheels to predetermined positions. Changing of the wheel-spacing is executed as follows: as a vehicle advances, the truck-supporting rails firstly contact with a part of the bogie frame and support a whole weight of the truck, whereby the wheels are released from loads and the lock pins are released. As a result, the wheels are allowed to slide in left and right directions and are shifted to new positions by the help of the guide rails, and then, the lock pins are inserted for defining new positions of the wheels and then, the truck is lowered from the truck-supporting rails, thereby completing the wheel-spacing changing operation.

③ Japanese Patent laid-open (Unexamined Publication) No. 54-47221 discloses a bogie truck. In this bogie truck, a pair of left and right plate-like bogie frames are arranged as separated from each other in left and right direction; wheels are rotatably mounted on front and rear portions of each bogie frame; there are provided under-spring bars supporting a vehicle body via springs, each bar being formed, on a lower surface thereof, with rack teeth extending in a rail-spacing direction, these rack teeth engaging with rack teeth formed at the middle portion of an upper surface of each of the bogie frame as extending in a rail-spacing direction. In order to change the truck wheel-spacing, the under-spring bars are firstly raised to be spaced from the rack teeth of the bogie frames by use of a belt conveyer, and then, as the vehicle body is advanced together with the under-spring bars and the wheels of the truck frames, the wheel-spacing as well as the bogie frame-spacing is changed by a pair of rails having a gradually changing track gauge. When the truck is completely advanced onto a railway having a final or target track gauge, the under-spring bar raised by a belt conveyer is again lowered until the rack teeth of the under-spring bar engages with the rack teeth of the bogie frame, thereby determining the wheel-spacing.

The above-mentioned prior arts, however, involve various problems as follows:

① In the first case of changing the track gauge, an enormous cost, labour and time are required for rebuilding or reconstructing the rail installation. Because of the unchanged truck wheel-spacing it is finally impossible for the vehicle to run on railways having different track gauges.

② In case of "TALGO TRAIN", since the truck is required to have a special bogie frame and wheel shafts, and the vehicle body itself is required to have a special truck-supported structure, it is difficult to change a conventional vehicle into a vehicle of a variable wheel-spacing truck of TALGO. FIG. 13A is a schematic plan view of a ground facility used for changing a truck wheel-spacing in TALGO. Between a railway 31*a* of narrower track gauge and a railway 33*a* of wider track gauge are arranged running paths 36*a* to be engaged with the bogie frame; lock release rails 37*a* for unlocking the lock pins for wheel shaft; inside guide rails 34*a*; and outside guide rails 35*a*. As mentioned above, in TALGO case, the number of parts constituting the ground facility is large, thereby increasing troublesome maintenance. Upon a wheel-spacing changing operation, water is sprinkled over the vehicle supporting rails for allowing the truck frame to slide easily, which further requires water-draining facility and maintenance of the draining facility.

③ In case of Japanese Patent Laid-open No. 54-47221, there may be a risk of overturn of the bogie frame, not only when the vehicle is raised above the bogie frame, but also during the running of the vehicle. It is difficult to maintain the moving speed of the bogie frame equal to that of the under-spring bar upon a wheel-spacing changing operation. Since the vehicle body is advanced while being raised above the bogie frame by the belt conveyer, there are required facilities of large size and complex structure. In addition, since the liftable weight is limited within a certain range, it is difficult to change the truck wheel-spacing with passengers in the vehicle.

SUMMARY OF THE INVENTION

In view of the above-mentioned disadvantages of the prior arts, the object of the invention is to provide a truck wheel-spacing changing method, a variable wheel-spacing truck and a ground facility therefor, in which advantages can be obtained by changing the bearing portion without further complication of basic structure of the bogie frame (frame of truck) and the truck; the running stability of the vehicle constituted by the vehicle body and the truck is not inferior to a conventional truck of a fixed wheel-spacing type; the ground facility includes no moving part; and maintenance of the variable wheel-spacing truck can be made easily.

For achieving the above objects of the invention, in a truck wheel-spacing changing method according to the present invention, (a) a truck to be moved from one railway of a track gauge onto another railway of a different track gauge is passed through a junction railway connecting the above two railways or through a non-rail railway section therebetween, (b) axle boxes supporting the wheels are slidably mounted on the wheel shaft or axle extending between side beams of a bogie frame, and each of the axle boxes is selectively fixed to the axle box receiver at one of a plurality of positioning points in the axle box by use of a releasable locking means, (c) in the above condition, when the truck runs from one railway into the junction railway or the no-rail railway, auxiliary wheels mounted on the axle box receivers engage with running paths and raise the vehicle body except the wheel sets, thereby releasing the above-mentioned locking means, (d) consequently, the truck is advanced along the junction railway or non-rail railway section where the track gauge of the junction railway or the intervals between the inside guide and outside guide rails in the no-rail railway section is changed, whereby a pair of guide rails or a pair of railway rails push the wheels of the truck, (e) by virtue of these pushing forces, the left and right axle boxes on the wheels are longitudinal (of the shaft) or transversely (of the vehicle) moved relative to each other, and a predetermined shifting of the wheel is completed and the position of the wheels are determined, (f) after then, the auxiliary wheels are separated from the running paths, thereby locking again the locking means and maintaining the same at a locking condition, and (g) then, the truck runs out of the junction railway or the no-rail track or railway into another railway, thereby completing a truck wheel-spacing changing operation.

For executing the above-mentioned method, a variable wheel gauge truck according to the invention comprises (A) a wheel shaft or axle extending between left and right side beams of a bogie frame and a pair of wheels mounted on the wheel axle, (B) the wheel being slidable in the longitudinal direction of the axle relative to the wheel axle, (C) axle boxes rotatably supporting the wheel (D) releasable locking means for fixing the axle box to the axle box receiver for supporting the axle box at a plurality of positions in the transverse direction, and (E) an auxiliary wheel rotatably mounted to the axle box receiver.

In this case, (F) the wheel may be allowed to rotate relative to the wheel axle, or (G) the wheel may be prevented from rotating relative to the wheel axle.

Further, (H) it is preferred that a shaft beam or axle beam formed with a axle box receiver at a part thereof is pivotally supported at one end thereof swingable or pivotal in a vertical direction.

Further for carrying out the above-mentioned method, a ground facility according to the invention comprises (1) a railway having a narrower track gauge, a railway having a wider track gauge and a junction railway connecting the railways of the narrow and wide track gauges and including front and rear portions where track gauge is constant and an intermediate portion where the track gauge continuously changes and (2) running path for the auxiliary wheels extending within the length of the junction railway, the running path being arranged, in plan view, so that a predetermined positional relation to the railway rails is maintained correspondingly to the track gauge, and being shaped, in elevational view, so that the path surface is maintained higher than a top surfaces of the rails of the junction railway beyond the whole length of the intermediate portion of the running path both end portions of the running paths being continuously inclined downwards.

In this case, (3) there may be arranged a pair of inside guide rails which extend beyond the whole length of the running paths within the junction railway and are arranged, in plan view, inside of the pair of railway rails with a predetermined positional relation to the track guage, and, in elevation view, with the top surfaces thereof maintained higher than the top surfaces of railway rails or (4) there may be arranged a pair of outside guide rails which extend beyond the whole length of the running paths within the junction railway and are arranged, in plan view, outside of the pair of railway rails within a predetermined positional relation to the track guage, and, in elevation view, with the top surfaces thereof maintained higher than the top surfaces of the railway rails, or there may be arranged (5) a pair of inside guide rails which extend beyond the whole length of the running paths within the junction railway and are arranged, in plan view, inside of the pair of railways rails with a predetermined positional relation to the track guage, and, in elevation view, with the top surfaces thereof maintained higher than the top surfaces of the railway rails, and (6) a pair of outside guide rails which extend beyond the whole length of the running paths within the junction railway and are arranged, in plan view, outside of the pair of railway rails with a predetermined positional relation to the track guage, and, in elevation view, with the top surfaces thereof maintained higher than the top surfaces of the railway rails.

Further, (7) the height of the running paths may be made lower over the whole length thereof relative to that of the running paths in the ground facility having the above arrangement (1) and (2), and the height of the railway rails may be made lower in a region shorter than the whole length of the running paths by an amount of equivalent to the height difference between the running path and the railway rail in the before-mentioned case (3) to (6), and in this case, (8) it is preferable that the height of the running paths and height of a part of the railway rails, side by side with the running paths are adjusted so as to maintain the center of gravity of the truck running on the railway rails at a constant level, i.e. to have the substantially the same height difference as that between the running path and railway rail in the case of (3) to (6).

Further, another ground facility for carrying out the above-mentioned method according to the invention comprises, (I) narrower track gauge rails, wider track guage rails, and no-rail railway section between the narrow and wide track gauge rails, (II) running paths for the auxiliary wheels arranged outside of the wider track guage railway rails in a widthwise or transverse direction and extending over a region including a part of the wider track gauge railway rails, a part of the narrower track gauge railway rails and the no-rail railway section in the longitudinal direction, and having a height higher than that of the railway rails, both end portions of the running paths being bent downwards, and (III) a pair of inside guide rails extending within a section of the running paths from the inside of the narrower track gauge railway rails to the inside of the wider track gauge railway rails, and having a height higher than that of the railway rails in a vertical direction.

Still another ground facility, for carrying out the method, according to the invention comprises, (I) narrower track gauge rails, wider track gauges rails, and no-rail railway section between the narrow and wide track gauge rails, (II) running paths for the auxiliary wheels arranged outside of the wider track gauge railway rails in a widthwise or transverse direction and extending over a region including a part of the wider track gauge railway rails, a part of the narrower track gauge railway rails and the no-rail railway section in the longitudinal direction, and having a height higher than that of the railway rails, both end portions of the running paths being bent downwards, and (IV) a pair of outside guide rails extending within a section of the running paths from the outside of the narrower track gauge railway rails to the outside of the wider track gauge railway rails, and having a height higher than that of the railway rails in a vertical direction.

The ground facility of this type may further comprise (V) a pair of inside guide rails extending within the section of the running paths from the inside of the narrower track gauge railway rails to the inside of the wider track gauge railway rails, and having a height higher than that of the railway rails in a vertical direction.

According to a truck wheel-spacing changing method having the above-mentioned features (a) to (g), when the truck moves, for example, from the narrower track gauge railway to the wider track gauge railway, the axle box receivers are raised by the auxiliary wheels just before the truck rides onto the junction railway, whereby the axle boxes are released from a load or weight of a vehicle body in case of the vehicle body being supported through the bogie frame. At the same time, the locking means having determined the position of the axle box and the wheel by engagement with the saddle-like portion of the axle box is released. This condition is continued during a period when the truck moves from the narrower track guage railway through the junction railway and completely into the wider track guage railway. During this process, the wheels on both sides are slided outwards together with the axle boxes relative to the wheel axle correspondingly to the change of the spacing between the rails, namely, track guage, and finally the spacing between the left and right wheels becomes equal to the spacing between the rails of the wider track guage railway. In this condition, each axle box receiver which has been raised by the auxiliary wheel is again lowered at another position on the shaft box corresponding to the position of the outwardly slided axle box, and locked at this position by the locking means. As a result, the spacing between the left and right wheels of the truck is maintained constant, and the track can run on the wider railway with stability. Meanwhile, when the truck is moved from a wider railway to a narrower railway, the truck wheel-spacing is changed through a process reverse to the above-mentioned one.

According to a variable wheel-spacing truck of the invention having the above-mentioned features (A) to (E), when the wheel-spacing of a truck is changed corresponding to the track guage change according to a ground facility having the features (1) and (2), each axle box receiver is raised relative to the wheel axle by the auxiliary wheel, the end portion of the axle beam escapes from a saddle-like portion on the axle box, thereby releasing the positioning function of the axle box receiver on the axle box. As a result, the wheel together with the axle box becomes slidable relative to the wheel axle, and the truck wheel-spacing is changed according to the change of the track guage by the aid of the railway rails or guide rails. Even when the axle box receiver is being raised by the auxiliary wheel, passengers on the vehicle can feel comfortable similarly to an usual running, because the load or weight of the vehicle body is supported by the auxiliary wheels through axle springs.

Further, in a variable wheel-spacing truck having the above-mentioned features (F), the running stability along a straight railway is superior, because each of the left and right wheels is able to freely rotate individually.

In a variable wheel-spacing truck having the above-mentioned feature (G) in addition to features (A) to (E), since the left and right wheels are both prevented from rotation, relative to the wheel axle, the behavior of the wheel is substantially the same as that of a conventional wheel.

In a variable wheel-spacing truck having the above-mentioned feature (H) in addition to features (A) and (E), the axle box receiver is smoothly raised by the auxiliary wheel by virtue of a lever function.

A ground facility having the above-mentioned features (1) and (2) is composed of railway rails and running paths, but includes no moving part. When a truck runs from a wider track gauge railway towards a narrower track gauge railway, the left and right auxiliary wheels are raised by the running paths, whereby the axle boxes escape from the axle box receiver and the locking condition is released. When the truck runs from a wider track gauge railway towards a narrower track gauge railway, the railway rails serve to push the wheels transversely inwards.

A ground facility having the above-mentioned feature (3) in addition to the features (1) and (2) is composed of railway rails, running paths and inside guide rails, but includes no moving part. When a truck runs from a narrower track gauge railway towards a wider track gauge railway, the left and right auxiliary wheels are raised by the running paths, whereby the axle boxes escape from the axle box receivers and the locking condition is released. When the truck runs from a narrower track gauge railway towards a wider track gauge railway, the inside guide rails serve to push the wheels transversed outwards. Further, when a truck runs from a wider track gauge railway towards a narrower track gauge railway, the left and right auxiliary wheels are raised by the running paths, whereby the axle boxes escape from the axle box receivers and the locking condition is released. When the truck runs from a narrower track gauge railway towards a wider track gauge railway, the railway rails serve to push the wheels transversely outwards.

A ground facility having the above-mentioned feature (4) in addition to the features (1) and (2) is composed of railway rails, running paths and outside guide rails, but includes no moving part. When a truck runs from a wider track gauge railway towards a narrower track gauge railway, the left and right auxiliary wheels are raised by the running paths, whereby the axle boxes escape from the axle box receivers and the locking condition is released. When the truck runs from a wider track gauge railway towards a narrower track gauge railway, the outside guide rails serve to push the wheels transversely inwards. Further, in this case, since the pushing forces acting on the wheels can be made stronger in comparison with those in case without the feature (4), there is a merit that junction railway section can be made shorter than that in case without the feature (4).

A ground facility having the above-mentioned features (5) and (6) in addition to the features (1) and (2) is composed of railway rails, running paths, inside guide rails and outside guide rails, but includes no moving part. It is possible for a truck to run from a narrower track gauge railway towards a wider track gauge railway, as well as to run from a wider track gauge railway towards a narrower track gauge railway. In either case, the left and right auxiliary wheels are raised by the running paths, whereby the axle boxes escape from the axle box receivers and the locking condition is released. When the truck run from a narrower track gauge railway towards a wider track gauge railway, the inside guide rails serve to push the wheels transversely outwards, while when the truck runs from a wider track gauge railway towards a narrower track gauge railway, the outside guide rails serve to push the wheels transversely inwards.

In a ground facility having the above-mentioned features (7) in addition to the features (1) and (2), in comparison with that having the features (3), or (4), or both (5) and (6), the height of the running path and the height of the railway rails are relatively low, and accordingly, the center of gravity of the vehicle running thereon is also relatively low.

In a ground facility having the above-mentioned feature (8) in addition to the features (1), (2) and (7), when the bogie frame is supported by the auxiliary wheel upon a truck wheel-spacing changing process, the height of the center of gravity of the truck and the vehicle (body) is maintained substantially constant from beginning of a wheel-spacing changing operation to end of the same. In consequence, no shock is given to passengers in the vehicle body and therefore it is ensured that the passenger can feel comfortable.

A ground facility having the above-mentioned features (I) to (III) is composed of running paths and inside guide rails, but includes no moving part. When a truck runs from a narrower track gauge railway towards a wider track gauge railway, the left and right auxiliary wheels are raised by the running paths, whereby the axle boxes escape from the axle box receivers and the locking condition is released. The inside guide rails serve to push the wheels transversely outwards. In this condition, although the axle boxes escape from the axle box receivers, they do not fall onto the rails, but are held slidably in left and right directions by brackets disposed under the axle box receivers.

A ground facility having the above-mentioned features (I), (II) and (IV) is composed of running paths and outside guide rails, but includes no moving part. When a truck runs from a wider track gauge railway towards a narrower track gauge railway, the left and right auxiliary wheels are raised by the running paths, whereby the axle boxes escape from the axle box receivers and the locking condition is released. The outside guide rails serve to push the wheels transversely inwards. In this condition, although the axle box escape from the axle box receivers, they do not fall onto the rails, but are held slidably in left and right directions by brackets disposed under the axle box receivers.

A ground facility having the above-mentioned feature (V) in addition to the features (I), (II) and (IV) is composed of running paths, inside guide rails and outside guide rails, but includes no moving part. It is possible for a truck to run from a narrower track gauge railway towards a wider track gauge railway, as well as to run from a wider track gauge railway towards a narrower track gauge railway. In either case, the left and right auxiliary wheels are raised by the running paths, whereby the axle boxes escape from the axle box receivers and the locking condition is released. In this condition, although the axle boxes escape from the axle box receivers, they do not fall onto the rails, but are held slidably in left and right directions by brackets disposed under the axle box receivers. When the truck runs from a narrower track gauge railway towards a wider track gauge railway, the inside guide rails serve to push the wheels transversely outwards, while when the truck run from a wider track gauge railway towards a narrower track gauge railway, the outside guide rails serve to push the wheels transversely inwards.

BRIEF DESCRIPTION OF DRAWINGS

FIGS. 1A to 1C show a sequence of changing a wheel-spacing according to a changing in a track gauge, wherein FIG. 1A is a side view of a variable wheel-spacing truck of self propelled type and ground facility with rails therefor according to a first embodiment of the present invention; FIG. 1B is a plan view of the ground facility shown in FIG. 1A; and FIG. 1C is a front elevational view of the truck, shown in FIG. 1A, when standing at locations A to G upon a truck wheel-spacing changing operation.

FIGS. 2A and 2B show an embodiment of a ground facility according to the present invention, wherein FIG. 2A is a side view of the ground facility provided with inside guide rails and outside guide rails; and FIG. 2B is a plan view of the same.

FIGS. 3A and 3B show another embodiment of the ground facility, wherein FIG. 3A is a side view of the ground facility provided with inside guide rails only; and FIG. 3B is a plan view of the same.

FIGS. 4A and 4B show still another embodiment of the ground facility, wherein FIG. 4A is a side view of the ground facility without junction railway; and FIG. 4B is a plan view of the same.

FIGS. 5A and 5B show a variable wheel-spacing truck according to an first embodiment of the present invention, wherein FIG. 5A is a plan view of this truck in case of standing on a narrower track gauge railway; and FIG. 5B is the same in case of standing on a wider track gauge railway.

FIGS. 9A and 9B show a variable wheel-spacing truck according to the first embodiment of the present invention as modified to a tracted truck, wherein FIG. 9A is a plan view of this variable wheel-spacing truck in case of standing on a narrower track gauge railway; and FIG. 9B is the same in case of standing on a wider track gauge railway.

FIGS. 13A and 13B are illustrative views for comparing a conventional ground facility with that according to the present invention, wherein FIG. 13A is a plan view showing a ground facility of the conventional "TALGO TRAIN" while FIG. 13B is a plan view of that according to the present invention.

DETAILED DESCRIPTION OF THE PREFERRED EMBODIMENTS

Referring to the attached drawings, embodiments of a variable wheel-spacing truck and a ground facility therefor, as well as a truck wheel-spacing changing method according to preferred embodiments of the present invention will be described below.

Figures 1A, 1B, 1C:
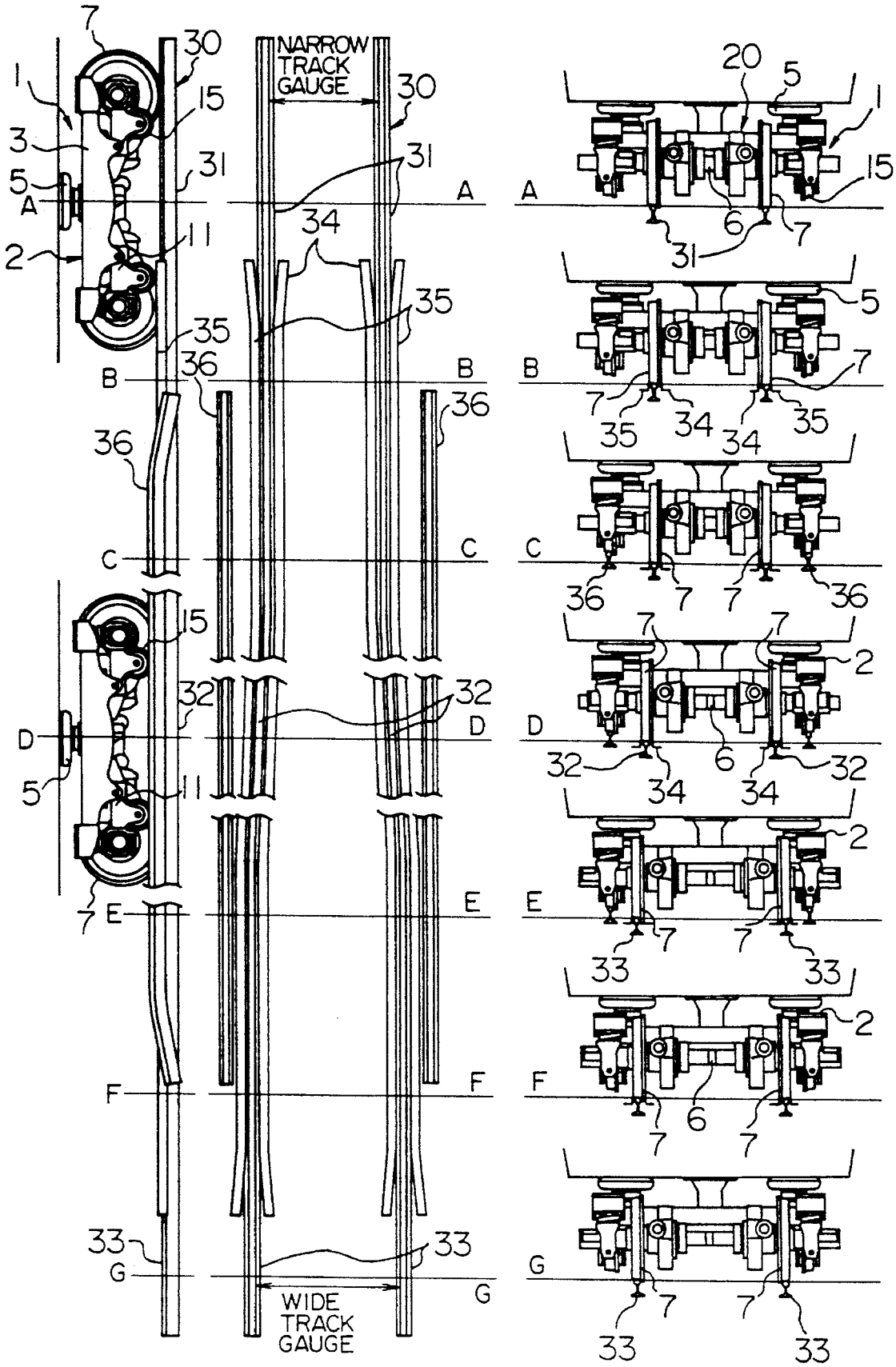

FIG. 1A is a side view of a ground facility for changing a truck wheel-spacing and a variable wheel-spacing truck, according to the first embodiment, standing typically at a location A and at a location D; FIG. 1B is a plan view of the track gauge-change ground facility; and FIG. 1C is elevational views of the ground facility and the variable wheel-spacing truck according to the first embodiment when standing at locations A to G.

Referring to FIGS. 1A to 1C, we now explain a sequence of changing the wheel-spacing from a magnitude for a narrower track gauge to a magnitude for a wider track gauge (in the following description, details of structure of truck 1 are shown in FIGS. 5A to 8C and 10).

At location A: a variable wheel-spacing truck 1 runs on rails 31, 31 of a narrower track gauge railway.

At location B: each of a pair of wheels 7,7 have introduced into between inside guide rails 34 and an outside guide rails 35.

At location C: auxiliary wheels 15 run on running paths 36, a height of which is determined to be able to raise the auxiliary wheels 15 upwards. When the auxiliary wheels 15 are raised, axle box receivers 12*b* are also raised. As a result, the bogie frame 2 is raised by the auxiliary wheels 15 (see also FIG. 10). In other words, by raising the axle box receivers 12*b* by the help of the running paths 36, the truck 1 except wheel set, and the vehicle body V are both raised. As a result, the wheels 7 and axles 6 are almost released from loads of the vehicle. Further, the axle box receiver 12*b* in a recessed groove 12 formed in a tip or distal end of an axle beam or axle beam 11 is pulled out from a saddle-like member 9*a* for narrower track gauge, and accordingly, it becomes possible for the wheel 7 together with the axle box 9 and a gear mechanism 20 to slide relative to the axle 6 in the rail widthwise direction, i.e. transverse direction (see also FIGS. 8A and 8B). In this process, the auxiliary wheel 15 is required to be raised upwards by a distance sufficient to make it possible for the saddle-like member 9*a* to be moved relative to the axle box receiver 12*b* with the most upper end of the saddle-like member 9*b* spaced apart from the lower end of the axle box receiver 12*b*.

At location D: the wheels 7 proceed from rails 31 of the narrower track or railway to rails 32 of a junction railway where the inside surfaces of the wheels 12 are guided by the inside guide rails 34, whereby the left and right wheels 7 gradually slide transversely outwards as the truck runs along the rails 32 of the junction railway having a gradually diverging track, i.e. gradually increasing track gauge or rail-spacing. As the wheels 7 slide relative to each other, the axle box 9 and the gear mechanism 20 also move transversely outwards together with the wheel 7. However, the positions of a side beam 3 of the truck frame 2 and the axle beam 11 are not changed. In other words, the axle box 9 is moved relative to the axle beam 11.

At location E: The wheels 7 have moved into rails 33 of the wider track gauge, where the spacing of the wheels 7 corresponds to the track gauge of the wider railway and the saddle-like member 9*b* of the axle box 9, corresponding to a wider track gauge is shifted to the position of the axle beam 11 (see also FIG. 8C).

At location F: the running paths 36 are terminated, and the auxiliary wheels 15 are lowered to the original level, whereby the vehicle body and the bogie frame 2 are also lowered; the axle box receivers 12*b* in the recessed grooves 12 are fitted into and positioned at the saddle-like members 9*b* for the wider track gauge; and the axle boxes 9 are again restricted by the side beam 3 of the truck frame 2 with the position thereof determined. Thus, the left and right wheels 7 are prevented from sliding relative to the axle 6 and fixed at predetermined positions.

At location G: the wheels 7 come out of a region between the inside and outside guide rail 34, 35, and the truck 1 is allowed to run on rails 33 of a wider track gauge.

Passing through the processes at the locations A to G, the wheel-spacing of the wheels 7 of the truck 1 is changed from a narrower one into a wider one. Further, when the truck 1 rides from a wider track or railway to a narrower track or railway, the difference, from the above narrow-to-wide case, in the wheel-spacing changing operation resides only in that the wheel 7 is guided inwards by the outside guide rails 35, but the other features are common to the above.

Figure 2A:
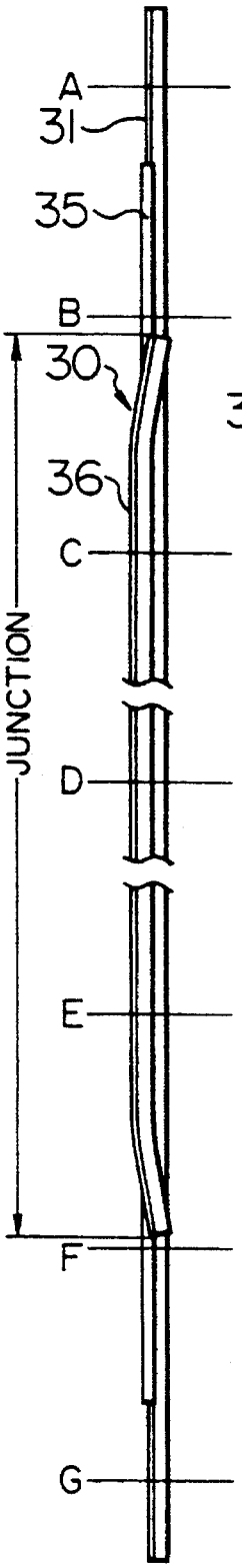
Figure 2B:
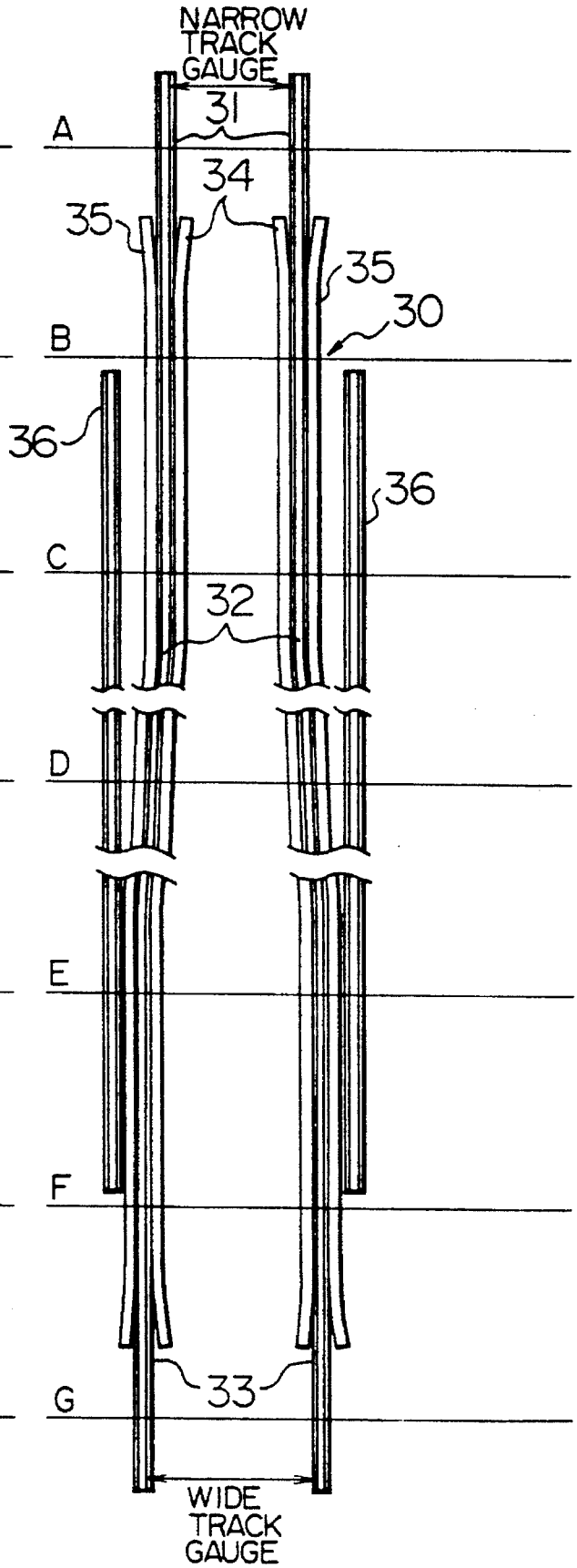

FIG. 2A is a right side view of a ground facility to be used for a variable wheel-spacing truck according to this embodiment, and FIG. 2B is a plan view of the same.

As shown in FIG. 2B, the ground facility 30 comprise narrower track gauge rails 31, wider track gauge rails 33, junction rails 32 connecting the narrower rails 31 with wider rails 32, inside guide rails 34 extending over the whole length of the junction rails 32 to press the back-gauge-sides of the wheels 7, outside guide rails 35 extending over the same length as the inside guide rails 34, to press the outside surfaces of the wheels 7 and a pair of left and right running paths 36 for passing the auxiliary wheels 15 thereon.

A pair of inside guide rails 34 are continuously arranged inside of the rails 31, 32, and 33 as separated therefrom with predetermined distances depending on the location between the narrow and wide gauge tracks. A top portion of each inside guide rail 34 having a pressing function is made a little higher than top surfaces of the rails 31, 32 and 33. Similarly, a pair of outside guide rails 35 are continuously arranged outside of the rails 31, 32, and 33 as separated therefrom with predetermined distances depending on the location between the narrow and wide gauge tracks. A top portion of each outside guide rail 34 having a pressing function is also made a little higher than top surfaces of the rails 31, 32 and 33. Further, both end portions of each of the inside guide rails 34 and the outside guide rails 35 are bent in directions separating away from the rail 31 or the rail 33 so that the wheel 7 may smoothly intrude into between the rail 31 or the rail 33 and the inside guide rail 34 or the outside guide rail 35. The length of the running paths 36 is shorter than the length of each of the inside guide rail 34 and the outside guide rail 35. The running paths 36 are arranged outside of the rails 31, 32 and 33. Further, end portions of each running path 36 are inclined downwards for allowing a smooth transitional running of the auxiliary wheel 15.

Figure 3A:
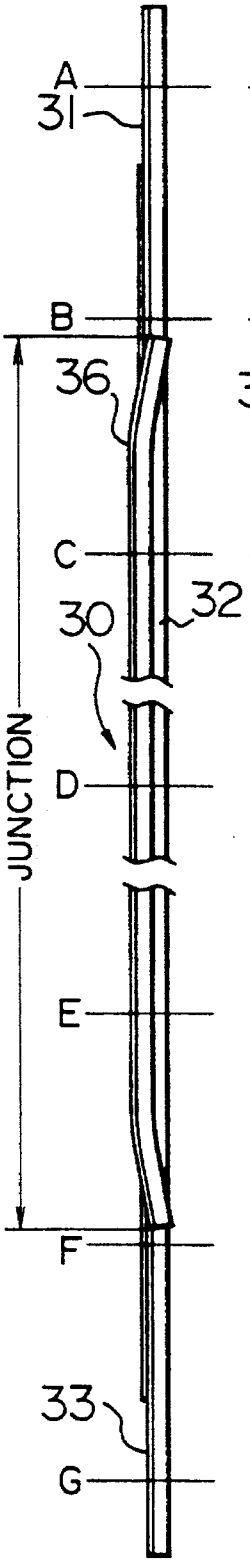
Figure 3B:
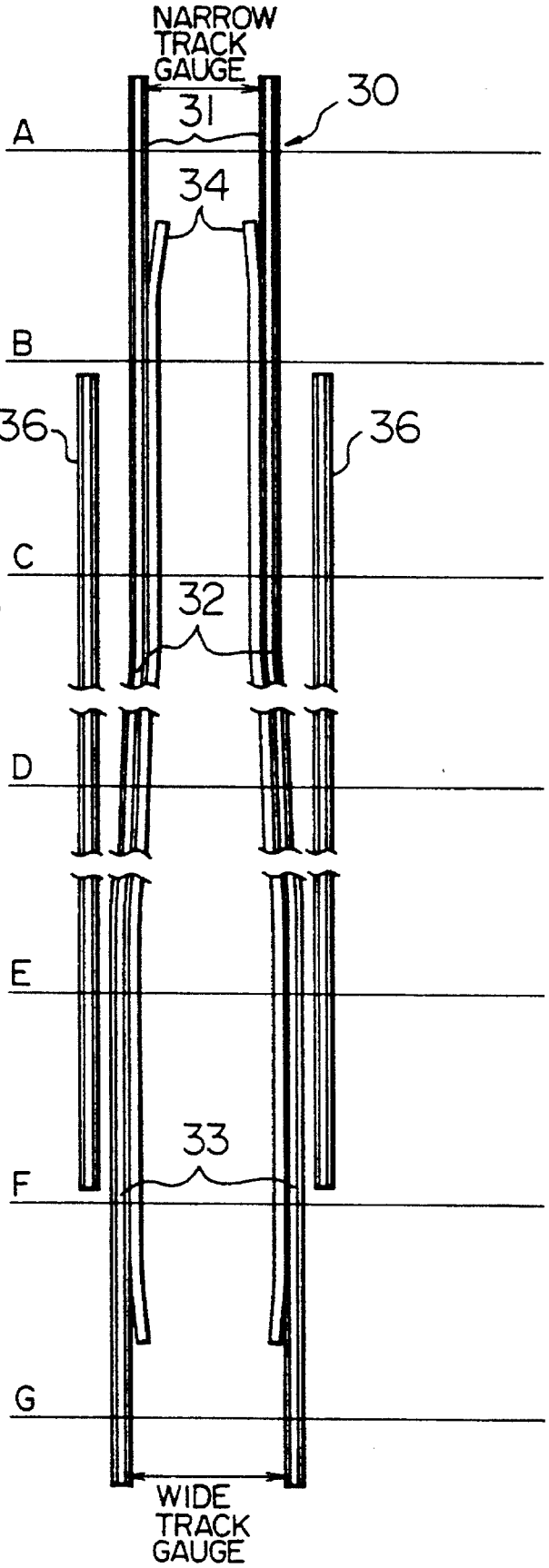

FIG. 3A is a right side view of another embodiment of a ground facility to be used for a variable wheel-spacing truck according to the embodiment of the invention, and FIG. 3B is a plan view of the same. FIGS. 3A and 3B show a modified embodiment of a ground facility shown in FIGS. 2A and 2B, in which no outside rail 35 is arranged.

In a ground facility shown in FIGS. 2A and 2B, a vehicle is allowed to intrude into the junction from a narrower railway as well as from a wider railway. A ground facility provided with no guide rail or only outside guide rails (not shown) is suitable to be used when a vehicle is intended to intrude into the junction only from a wider railway, while a ground facility provided with only inside guide rails as in FIGS. 3A and 3B is suitable to be used when a vehicle is intended to intrude into the junction only from the narrower railway.

Figure 5A:
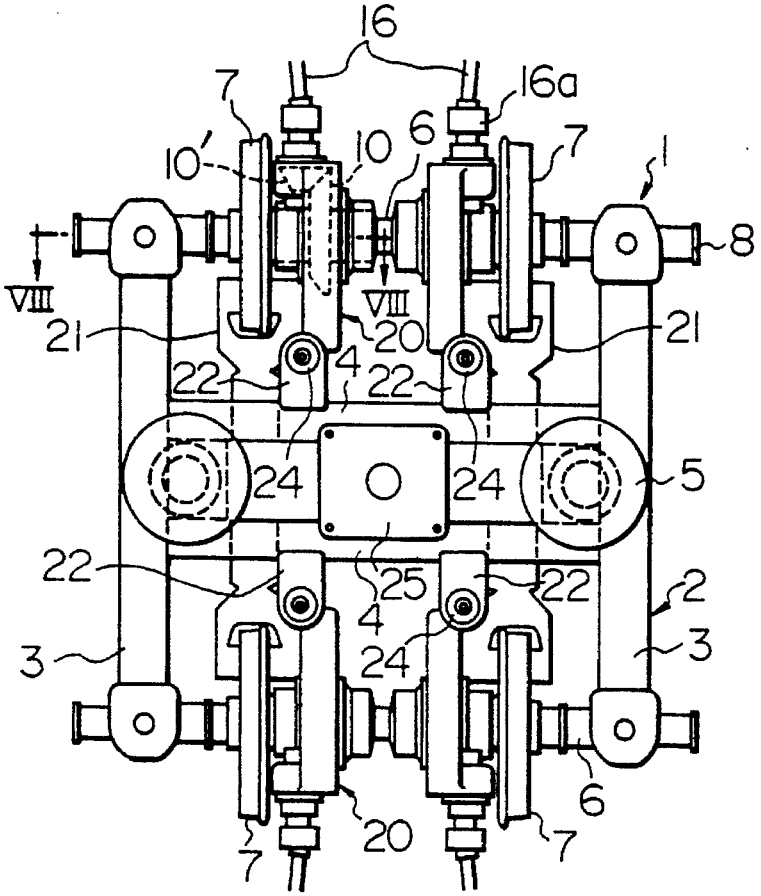
Figure 5B:
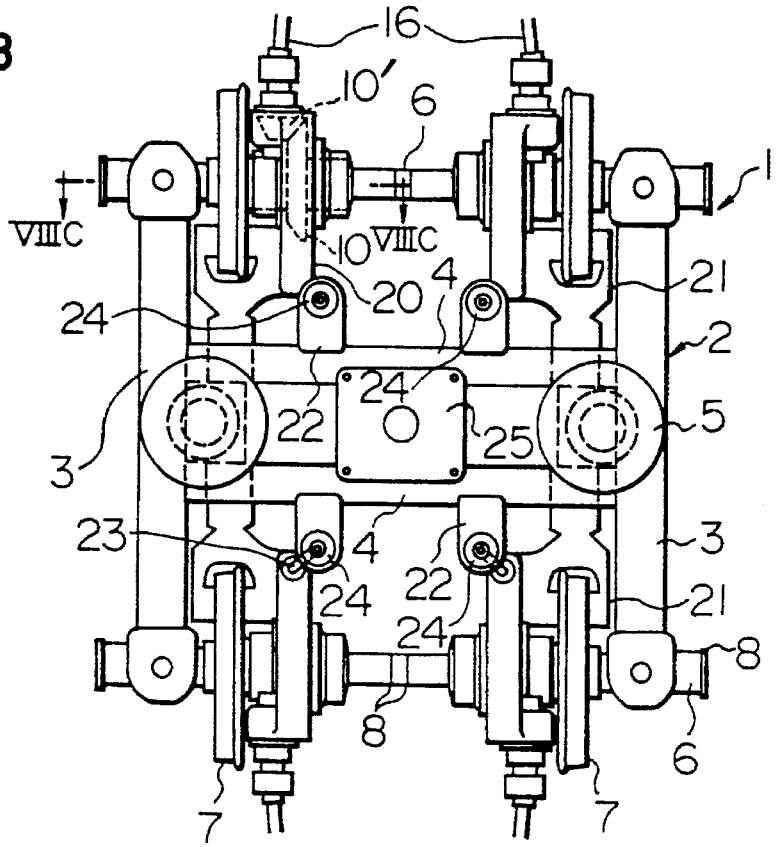
Figure 6A:
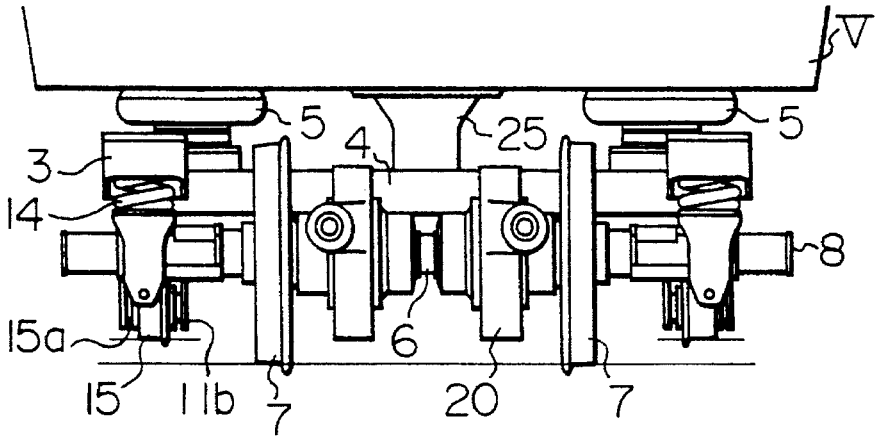
FIG. 6A shows a front elevational view of the variable wheel-spacing truck shown in FIG. 5 in case of standing on a narrower track gauge railway.
Figure 6B:
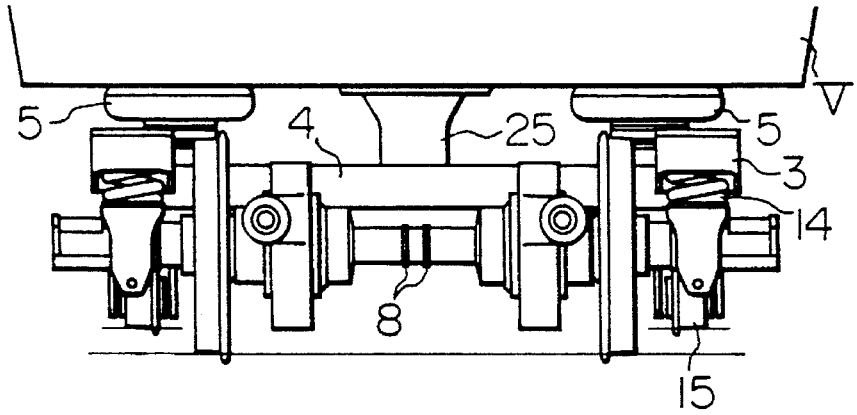
FIG. 6B is the same in case of standing on a wider track gauge railway.
Figure 7:
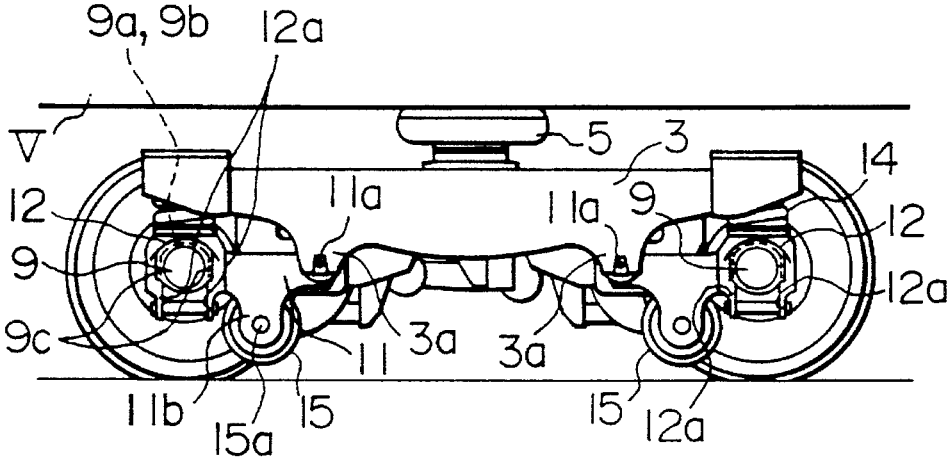
FIG. 7 is a side view of a variable wheel-spacing truck shown in FIG. 5 in case auxiliary wheel is not acting.

FIGS. 5A and 5B, FIGS. 6A and 6B and FIG. 7 show an embodiment of the variable wheel-spacing truck according to the present invention. FIGS. 5A and 5B are plan views of the variable wheel-spacing truck 1 standing at the location A on the narrower railway and at the location G on the wider railway, respectively; FIGS. 6A and 6B are front elevational views of the variable wheel-spacing truck standing at the location A on the narrower railway and at the location G on the wider railway, respectively; and FIG. 7 is a side view of the variable wheel-spacing truck.

As shown in FIG. 5A, the variable wheel-spacing truck 1 according to this embodiment comprises substantially H-shaped truck frame 2 constituted by a pair of left and right side beams 3 opposed to each other and two parallel transoms 4 connecting the side beams 3 at intermediate positions thereof. On the middle portion of each side beam 3 is mounted a supporting seat 5 of a disk-shape for supporting the weight of the vehicle V. One each of a pair of front and rear axles 6 bridging respectively between front ends of the left and right side beams 3 and between rear ends of the side beams 3, are mounted left and right wheels 7, each of which is adapted to be slidable relative to the axle 6 in a range between stoppers 8, 8 (refer to FIGS. 8A to 8C).

Figure 8A:
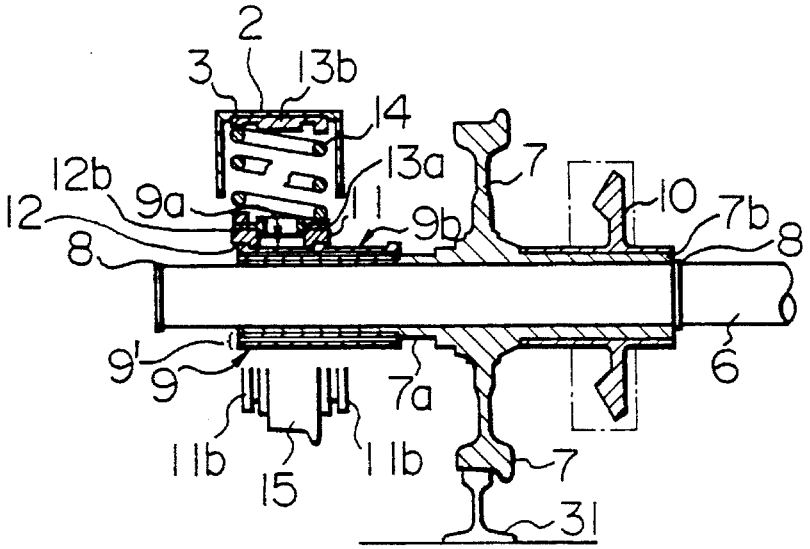
FIG. 8A is a sectional view taken along a line VIII—VIII of FIG. 5A.
Figure 8B:
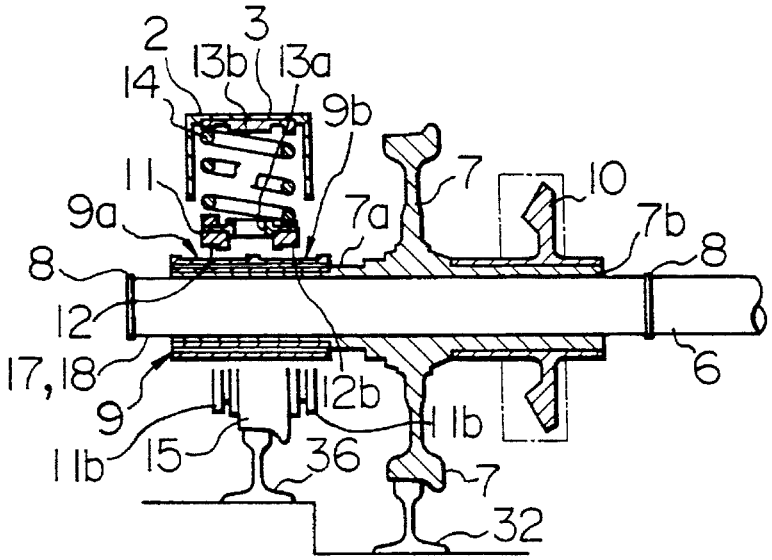
FIG. 8B is a sectional view taken along line VIII—VIII of FIG. 5A when the truck stands at a location D shown in FIG. 1C
Figure 8C:
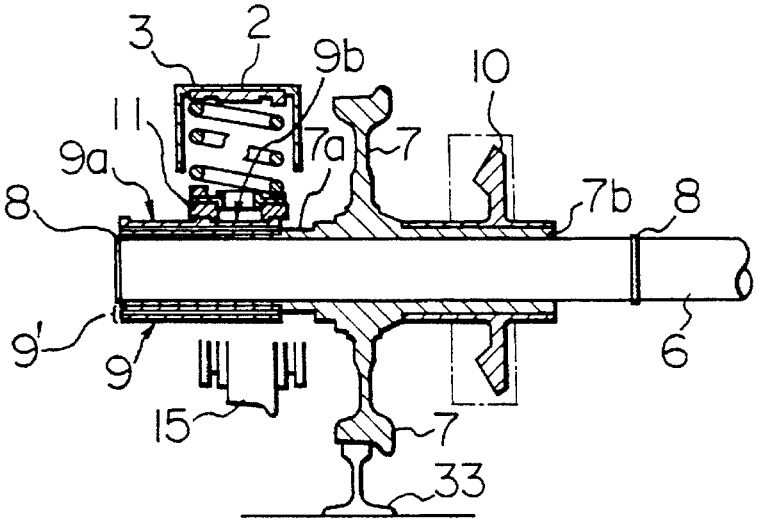
FIG. 8C is a sectional view taken along line VIIIC—VIIIC of FIG. 5B.

The wheel 7 may be mounted on the axle 6 as prevented from rotating relative to the axle 6 by means of a spline 17 (FIG. 8B), or otherwise may be mounted through a plane bearing 18 as allowed to rotate relative to the axle 6 (FIG. 8B). A supporting portion of the wheel 7 has an inwardly extended portion 7*b* and an outwardly extended portion 7*a* as shown in FIGS. 8A to 8C. The outwardly extended portion 7*a* is rotatably supported at an outer peripheral surface thereof by a bearing 9' incorporated in the axle box 9. The axle box 9 is constructed so as to be able to slide together with the wheel 7, the gear mechanism 20 and brake mechanism 21 relative to the axle 6 (FIGS. 5A and 5B). The upper portion of each axle box 9 is formed with the concave saddle-like portion 9*a* for the narrower track gauge and the concave saddle-like portion 9*b* for the wider track gauge. Further, around the inwardly extended cylindrical supporting portion 7*b* is press-fitted a driven bevel gear 10 which rotates together with the wheel 7.

A rotating force from a driving motor not shown is transmitted to the bevel gear 10 fixed to the wheel 7 slidably monted on the axle 6 through a power transmitting axle 16, a universal joint 16*a* and a driving bevel gear 10' engaged with the bevel gear 10, thereby rotating the wheel 7 (FIGS. 5A and 5B). By connecting each bracket 22, which is fixed to the transom 4 with the gear mechanism 20, by means of a link 23 having flexible rubber bushes 24 at both ends thereof for meeting both conditions of the narrower track gauge and the wider track gauge, a rotary reaction force generated by a driving of the gear mechanism 20 or an actuation of the braking mechanism 21 is transmitted to the truck frame 2. A vehicle tracting mechanism 25 disposed at the central portion of the truck 1 has a function to transmit a forward or backward tracting force from the truck 1 to the vehicle body V. Weight or load of the vehicle body V does not directly act on the tracting mechanism 25.

As shown in FIG. 7, each of the side beams 3 integrally has, at lower parts near the longitudinally middle portion thereof front and rear brackets 3*a*, each of which pivotally supports a proximal end of an axle beam 11 through a axle 11*a*. The axle beam 11 is formed at a distal end portion thereof with a concave groove 12 opened downwards. The concave groove 12 includes flat fitting surfaces 12*a* opposed and parallel to each other. The axle box 9 are fitted to the concave groove 12 so that front and rear outer flat surfaces 9*c* of the axle box 9 is slidable relative to the flat surfaces 12*a* of the groove 12 in vertical and lateral directions, while preventing the rotation of the axle box 9. The axle beam 11 is formed at a suitable position thereof with auxiliary wheel-supporting portions 11*b*, extending downwards, between which is rotatably mounted an auxiliary wheel 15 through a supporting axle 15*a*. The axle box receiver 12*b* in the concave groove 12 of the axle beam 11 is adapted to be able to selectively fit to the saddle-like portion 9*a* or to the saddle-like portion 9*b* of the box 9 as described before.

As shown in FIGS. 8A to 8C, on each distal end portion of the axle beam 11 is provided a spring receiving seat 13*a*, and inside of each end portion of the side beam 3 is also provided a spring receiving seat 13*b*. Between the spring receiving seat 13*a* and 13*b* is provided an elastic member or an axle spring 14 in a compressed condition. By virtue of this arrangement, the truck frame 2 is supported on the distal end portions of the axle beam 11 through the axle springs 14, while each axle beam 11 is disengageably or releasably positioned in the saddle-like portion 9*a* or 9*b* of the axle box 9.

In FIG. 8B, the truck frame 2 is supported by the auxiliary wheels 15 running on the running paths 36, whereby the axle box receivers 12*b* in the associated concave grooves 12 of the distal end portions of the axle beams 11 is pushed out from the saddle-like portions 9*a* and 9*b* of the axle boxes 9. In consequence, the wheels 7 are slidable relative to the axles 6 in the longitudinal direction of the axles 6, and run along the junction rail 32 under the guide of the outside guide rails 35 or the inside guide rails 34. More precisely, each wheel 7 receives the weight or load of the axle 6, the axle box 9, the bevel gear 10 and the wheel 7 itself, but no load of the vehicle body V and the truck frame 2. Accordingly, the wheels 7 are moved smoothly on and along the axle 6.

Figure 9A:
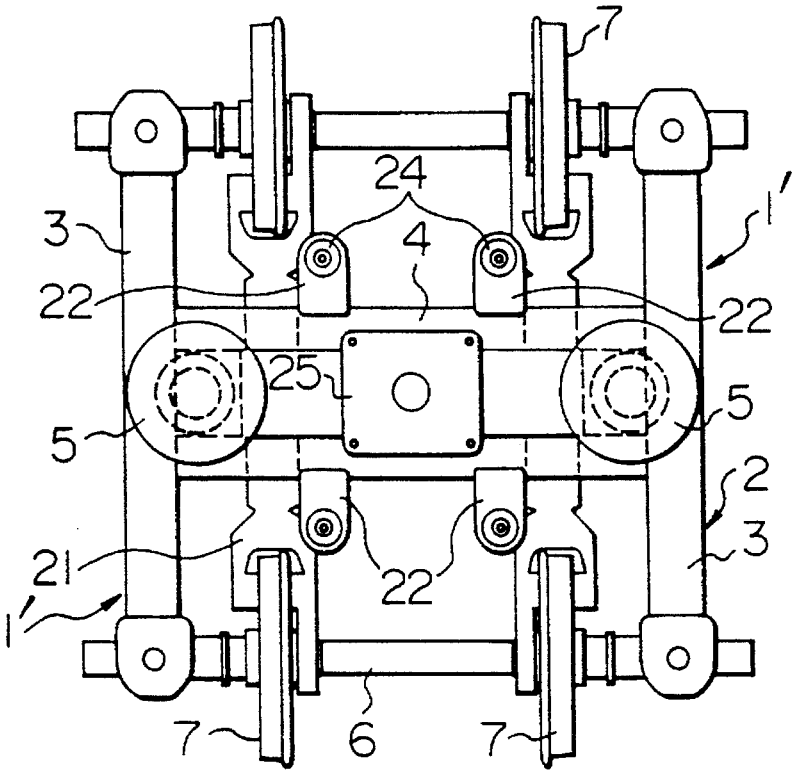
Figure 9B:
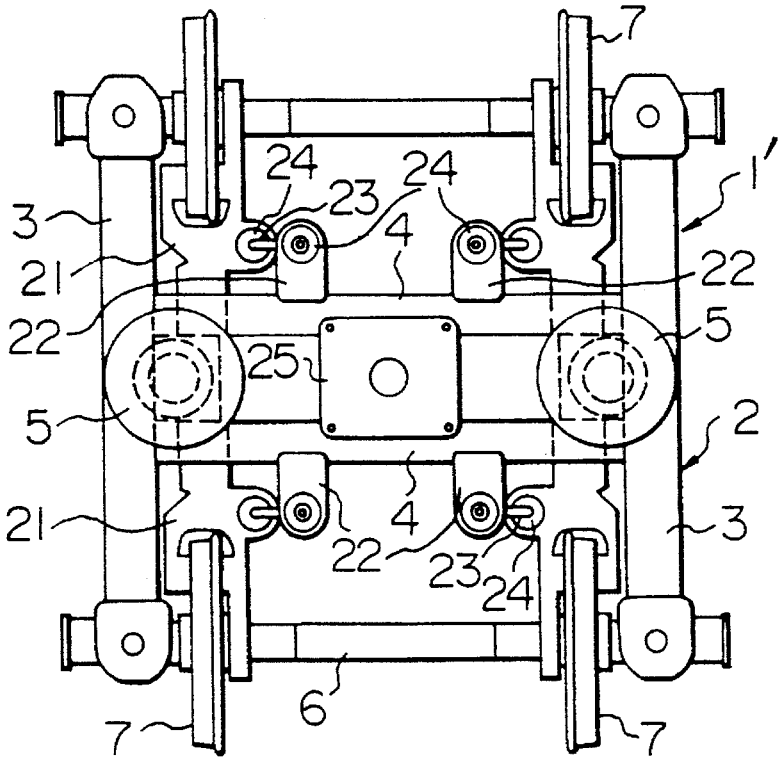

FIGS. 9A and 9B are plan views of a variable wheel-spacing truck according to another embodiment of the present invention, in conditions of standing on a narrower gauge track and on a wider gauge track, respectively, as corresponding to FIGS. 5A and 5B. As shown in FIG. 9A, the truck 1' of this embodiment is a tracted one which is equipped with neither power transmitting axle 16 nor bevel gear 10 for transmitting rotary power from a motor to the wheel 7. Therefore, the central supporting portion integrated with the wheel 7 has only an outwardly extended portion (7*a* in the case of FIGS. 8A–C), but no inwardly extended cylindrical supporting portion (7*b* in the case of FIGS. 8A to 8C). The axle box 9 is adapted to be slidable together with the wheel 7 and the braking mechanism 21 relative to the axle 6. By connecting the braking mechanism 21 with the associated bracket 22 fixed to the transom 4 by use of the associated link 23 mounted at each end thereof with the flexible rubber bush 24 applicable to both of a narrower track gauge and a wider track gauge, a rotary reaction force resulted from a braking action of the braking mechanism 21 is transmitted to the bogie frame 2.

The truck 1' of this embodiment differs from the truck 1 of the first-mentioned embodiment only in that the latter is of a self-propelled type and the former is of a tracted type, but other structures as well as the ground facility shown in FIGS. 2A and 2B are common to both embodiments. Therefore, the common members are denoted with the same numerals or symbols in the figures.

Figure 10:
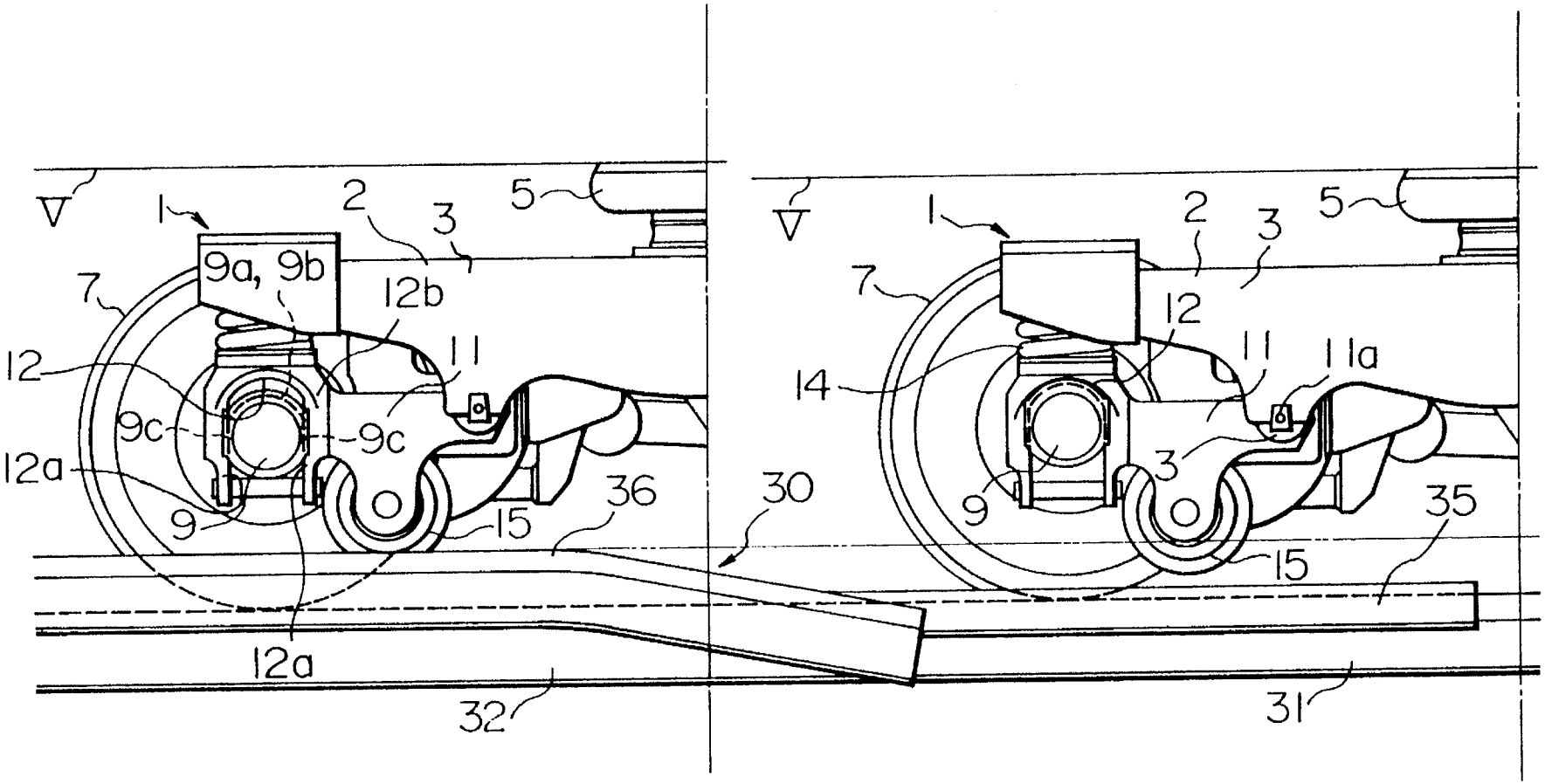
FIG. 10 is an enlarged side view of a part of the truck shown in FIG. 1A, wherein right side half portion shows a state just before as auxiliary wheel mounted on a bogie frame reaches the running path, while left side half portion shows a state just after the auxiliary wheel rides onto the running path.

FIG. 10 is an enlarged side view of a part of the truck shown in FIG. 1A, wherein the right half and the left half show the truck in conditions just before the auxiliary wheel 15 reaches the running path 36 and just after it runs onto the running path 36, respectively.

As shown in FIG. 10, when the auxiliary wheel 15 moves upwards along the inclined portion of the running path 36 and completely runs onto the horizontal portion of the same, the side beam 3 of the bogie frame 2 is raised as a whole by the auxiliary wheels 15 through the axle springs 14 and the axle beam supporting portion 11*a*, whereby the vehicle is raised as a whole only excluding the wheel sets. In this condition, the total weight of the truck 1 and the vehicle body V is supported by the auxiliary wheels 15, and the wheels 7 are acted on substantially only by the weight of the wheel sets.

Figure 11:
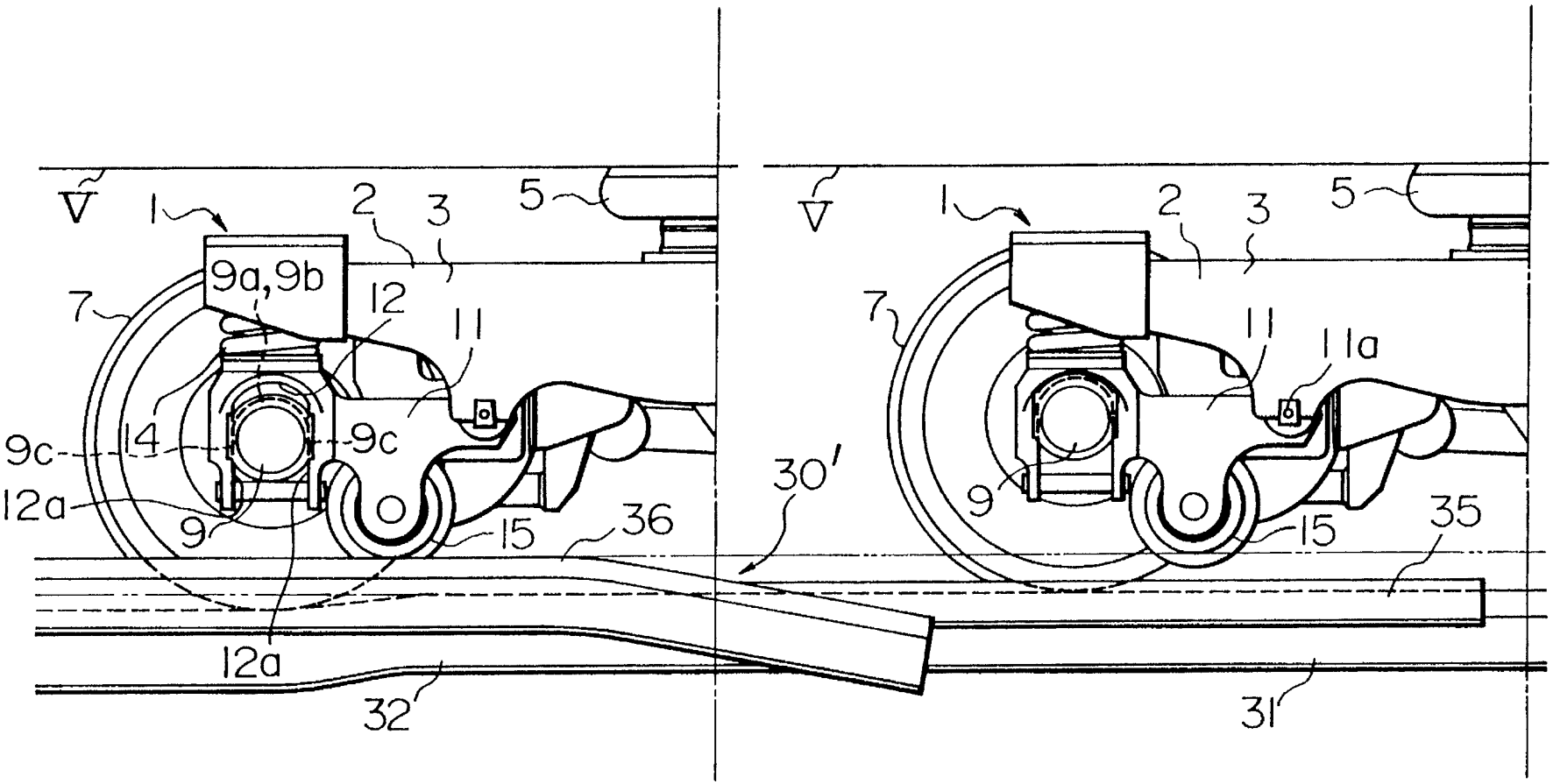
FIG. 11 is an enlarged side view showing another embodiment of a ground facility as corresponding to FIG. 10.

FIG. 11 shows another embodiment of the ground facility, and is a side view of a part of the truck 1, wherein the right half and the left half show the truck 1 in conditions just before the auxiliary wheel reaches the running path 36 and just after it runs onto the running path 36, respectively.

In a ground facility 30' of this embodiment, the vertical displacement of the vehicle body V is relatively small between in an usual running of the vehicle as shown in the right half and in the wheel-spacing changing running shown in the left half. More specifically, in an arrangement shown in FIG. 10, the auxiliary wheel 15 is raised and the vertical position of the vehicle body V is changed. In an arrangement shown in FIG. 11, however, for preventing substantially this vehicle height change, the height of the running path 36 is so determined as to maintain the height of the auxiliary wheel at substantially the same level both upon the usual running and upon the wheel-spacing changing running, and the level of the rail at the junction including the track gauge-changing rail 32 as well as a part of the rail 31 and a part of the rail 33 as extending beyond the track gauge gradually changing region side by side with the running path 36 is made lower than the level of the rails 31, 33 at locations away from the junction thereby enabling to keep the height of the auxiliary wheels shown in the left half of FIG. 11 at the same level as that shown in the right half of FIG. 11.

Figure 4A:
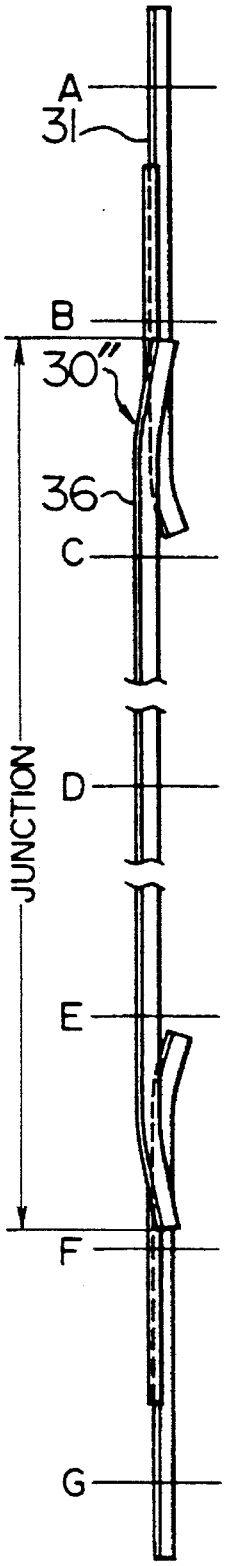
Figure 4B:
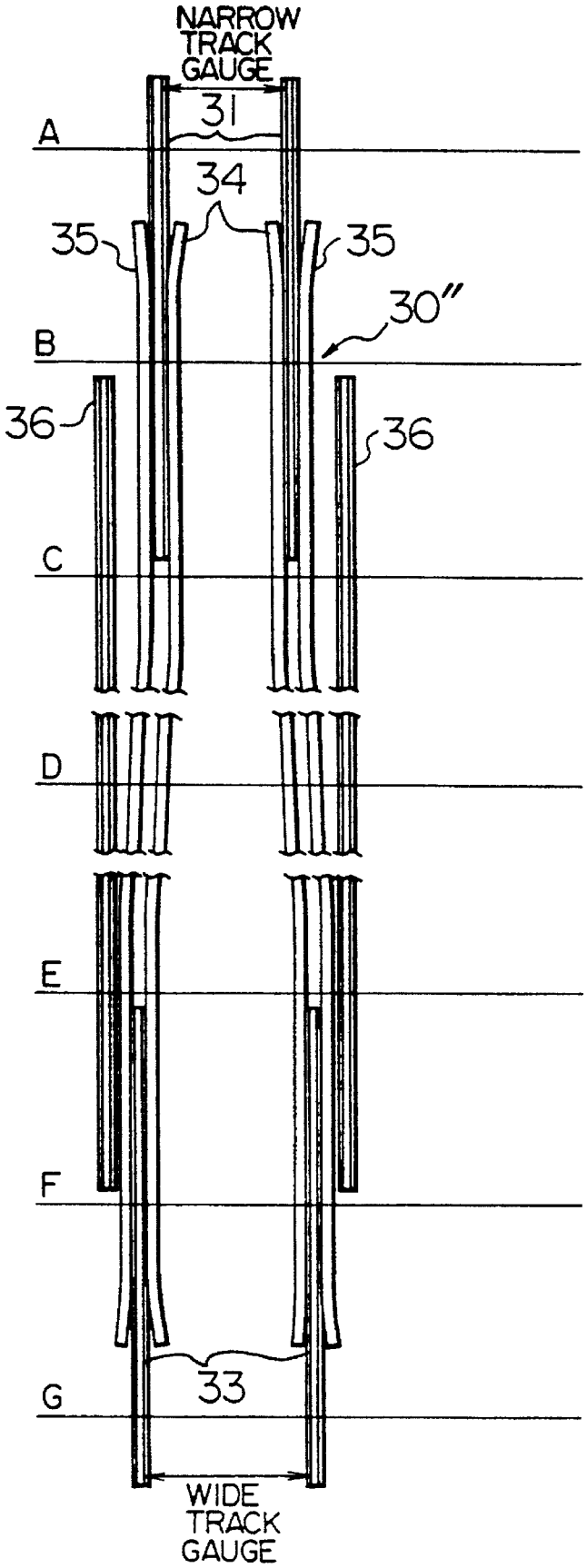

FIG. 4A is right side view of a ground facility according to a still another embodiment of the present invention, and FIG. 4B is a plan view of the same. As shown in FIG. 4B, this ground facility 30" is different from the ground facility 30 shown in FIGS. 2A and 2B in that the junction rails 32 are not provided within a part of a extending region of the running paths 36, and end portions of the wider track gauge rails and the narrower track gauge rails are all bent downwards.

Figure 12:
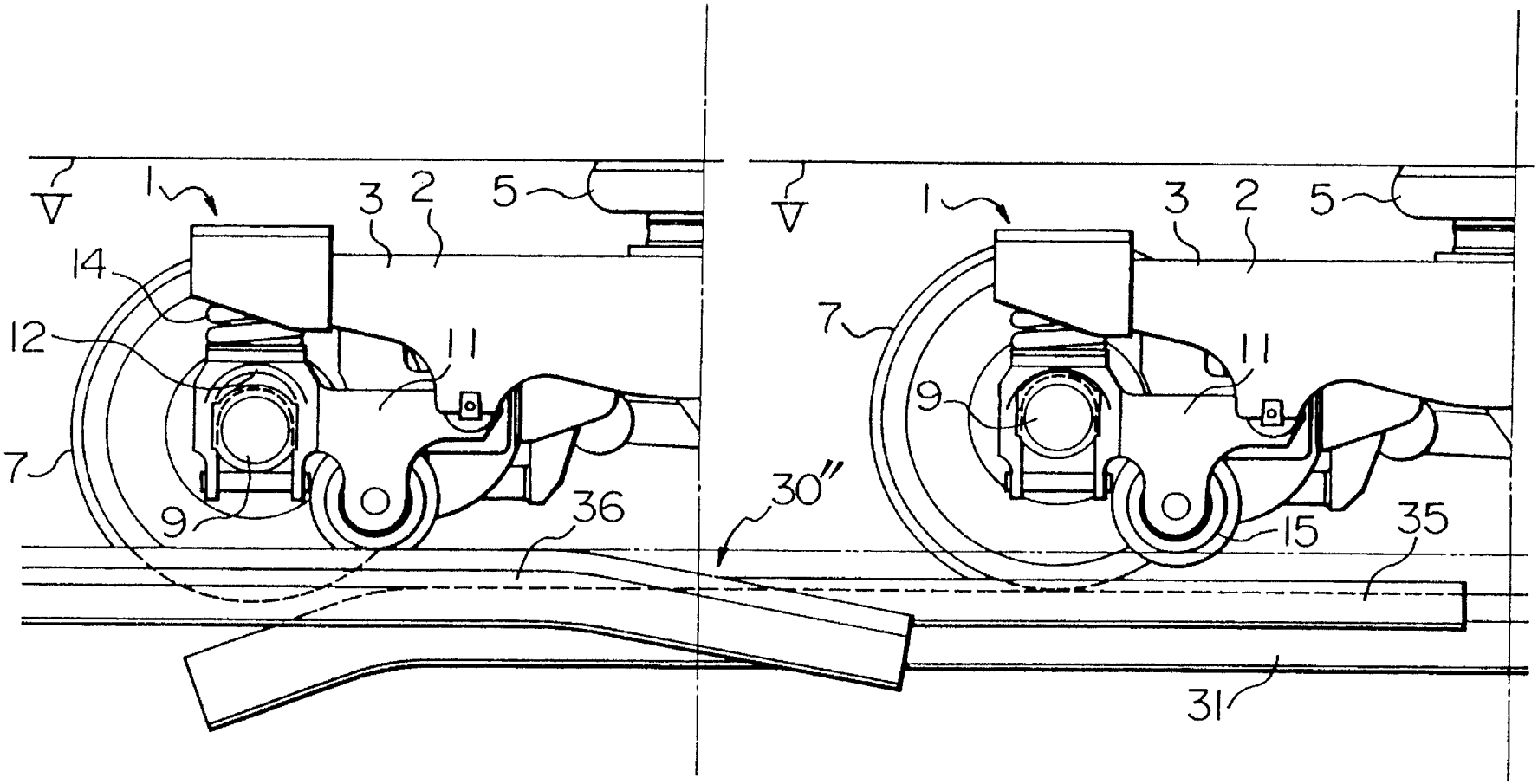
FIG. 12 is an enlarged side view of a part of the truck shown in FIG. 4A, wherein right side half portion shows a state just before an auxiliary wheel mounted on a truck frame reaches the running path, while left side half portion shows a state just after the auxiliary wheel rides onto the running path.

FIG. 12 is an enlarged side view of a part of the truck and ground facility shown in FIG. 4A, wherein the right half and the left half show the truck 1 in conditions just before the auxiliary wheel reaches the running path 36 and just after it runs onto the running path 36, respectively.

Figure 13A:
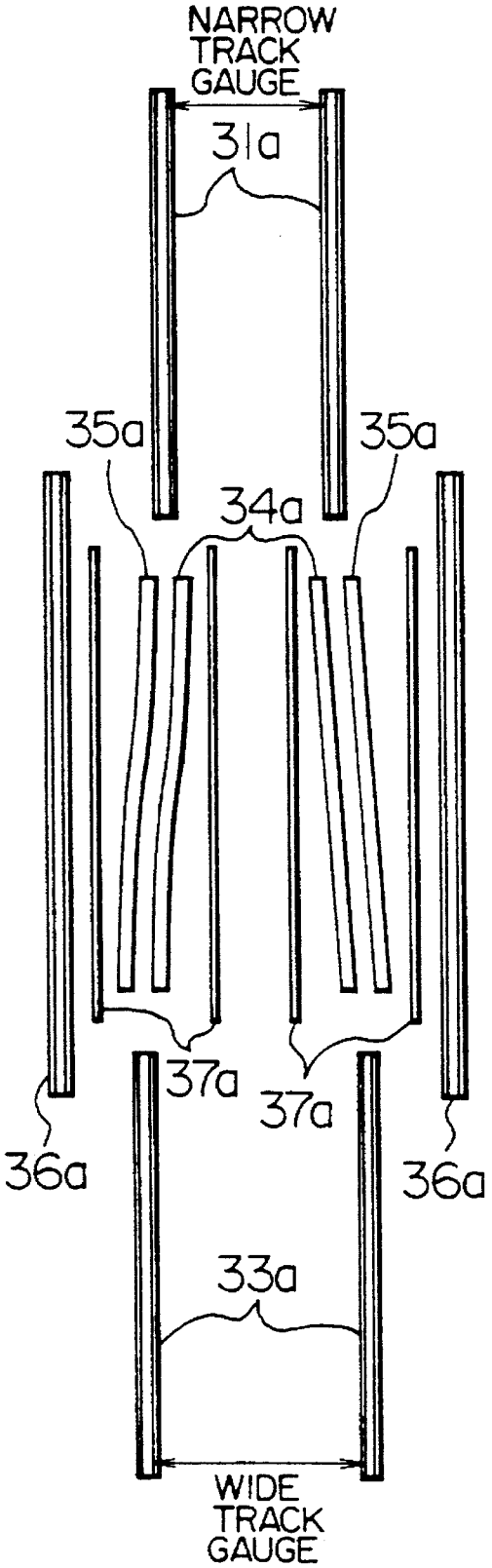
(PRIOR ART) FIG. 13A
Figure 13B:
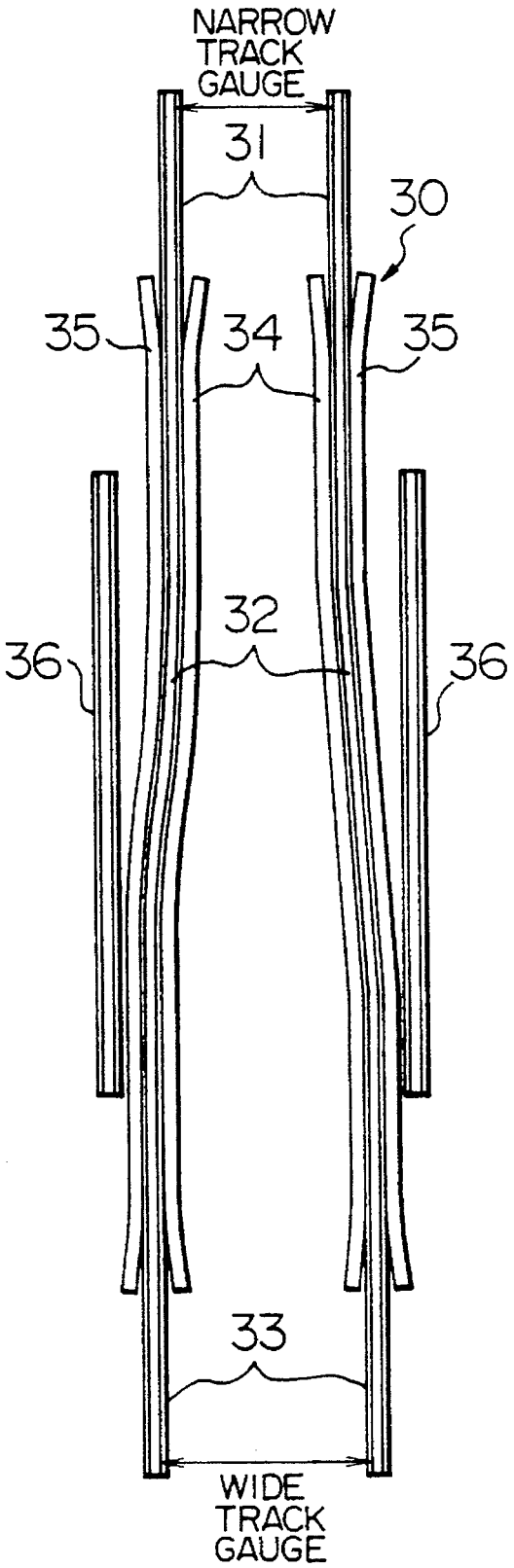

FIGS. 13A and 13B are illustrative views for comparing a wheel-spacing changing ground facility according to the present invention (FIG. 13B) with that of a prior art (FIG. 13A), wherein FIG. 13A is a plan view of a ground facility of TALGO, while FIG. 13B is that of the present invention.

In case of TALGO shown in FIG. 13A, between rails 31*a* of narrower track gauge and rails 33*a* of wider track gauge are arranged running paths 36*a* which engage with truck frames and support the whole vehicle body. The truck is equipped with lock pins for determining the wheel-spacing at a narrower one or a wider one. There are arranged lock releasing rails 37*a* for releasing the lock pins, and further, inside guide rails 34*a* and outside guide rails 35*a*. Here, items requiring dimensional precision are positional dimensions and relative intervals among the terminal ends of the rails 31*a* of narrower track gauge, the rails 33*a* of wider track gauge, the running paths 36*a*, the lock releasing rails 37*a*, the inside guide rails 34*a*, and the outside guide rails 35*b*, as well as relations in parallelism and height between the running paths 36*a* to be engaged with the truck frame and the lock releasing rails 37*a*.

On the other hand, in case of the invention shown in FIG. 13B, between the rails 31 of narrower track gauge and the rails 33 of wider track gauge are provided not only the running paths 36 but also inside guide rails 34 and/or outside guide rails 35, and/or junction railway 32. In consequence, the items requiring dimensional precision are only the positional dimensions and relative intervals, at the terminal portions of the running paths 36, of the running paths 36 relative to the rails 31*a* of narrower track gauge and the rails 33*a* of wider track gauge, and parallelism of the running path 36.

As mentioned above, the wheel-spacing changing ground facility according to the invention includes few parts requiring dimensional precision and is simplified. Meanwhile, the inside guide rails 34, 34*a* and the outside guide rails 35, 35*a* are required, in both cases shown in FIGS. 13A and 13B, to have neither smooth planer surface nor exact linearility.

As obvious from the above description, a truck wheel-spacing changing method, a variable wheel-spacing truck and a ground facility according to the present invention have the following advantages:

In a truck wheel-spacing changing method according to the invention, the structure of a variable wheel-spacing truck becomes simple, and a new structure can be obtained only by improving the bearings including the axle beams of a conventional truck.

A variable wheel-spacing truck according to the invention, is suitable to be applied to a tracted truck, but can be applied to a self-propelled truck as well.

A ground facility according to the present invention is composed of railway rails and running paths, or of railway rails, running paths and guide rails, but includes no moving part.

Specially, when compared with the "TALGO TRAIN", the invention has the following merits. The ground facility of the invention includes fewer items requiring a dimensional precision, and has a simpler structure. In contrast to the ground facility of the "TALGO TRAIN" which requires a water spraying device, the present invention requires no such device and no equipment associated therewith. Further, in contrast to the truck of "TALGO TRAIN" which is provided with slidable lock pins releasable by sliding the lock pins the locking/lock-releasing mechanism of the invention requires no lock pin, thereby making the structure simpler and the maintenance easier. Since the locking mechanism of the truck of "TALGO TRAIN" is provided separately or independently from the vehicle supporting structure, it is required to arrange on the ground a lock-releasing installation and a vehicle supporting installation separately or independently from each other. In contrast to this arrangement of "TALGO TRAIN", in the invention, these two installations are integrated into one unit, and only a vehicle supporting installation is required on the ground.

What is claimed is:

1. A method of changing wheel-spacing of a truck to be moved from a first railway of a first track gauge into a second railway of a second track gauge different from the first track gauge through a junction railway or a no-rail railway section between the first and second railway, the truck being equipped with axle boxes for rotatably supporting main wheels, each axle box being slidably mounted on an associated axle extending between side beams of a bogie frame and axle box receivers each selectively and releasably connected with one of the axle boxes at one of a plurality of predetermined positions, comprising the steps of:

moving the truck from the first railway to the junction or no-rail railway section and engaging auxiliary wheels mounted directly or indirectly on each of the axle box receivers of the truck with running paths to produce relative vertical movement between the vehicle body and the main wheels and release a locking engagement between each axle box and one of the axle box receivers and free the axle boxes for transverse movement on the axle, moving the truck through a region where the track gauge of the junction railway gradually changes or a spacing between a pair of inside or outside guide rails arranged in the no-rail railway section gradually changes to push the main wheels by the pair of junction railway rails or guide rails and shift the main wheels transversely together with the associated axle boxes, to predetermined positions, relative to the axle, passing the truck completely through the junction or no-rail railway section after disengaging the auxiliary wheels from the running paths to restore the locking engagement between the axle boxes and the axle box receivers, and subsequently moving the truck from the junction or no-railway section into the second railway.

2. A variable wheel-spacing truck comprising:

a bogie frame having side beams, an axle extending between the side beams, a pair of wheels mounted on the axle slidably relative thereto in a transverse direction of the truck, axle boxes rotatably supporting the wheels, axle box receivers supporting the axle boxes, each of the axle box receivers being formed on an associated axle beam, each axle beam being pivotally mounted on one of the side beams so as to be swingable in a vertical direction, releasable locking means for fixing the axle boxes to the axle box receivers at a plurality of positions arranged in a transverse direction of the truck, and auxiliary wheels rotably mounted on the axle box receivers.

3. A variable wheel-spacing truck as claimed in claim 2 wherein at least one of the wheels is allowed to rotate relative to the axle.

4. A variable wheel gauge truck as claimed in claim 2 wherein each wheel is prevented from rotating relative to said axle.

5. A ground facility for changing a wheel-spacing of a variable wheel-spacing truck equipped with locking means for the wheels, the ground facility comprising:

a narrower track gauge railway of a first track gauge, a wider track gauge railway of a second track gauge greater than the first track gauge, a junction railway connecting the narrower track gauge railway with the wider track gauge railway and including a middle portion having a gradually changing track gauge and end portions each having a constant track gauge, and running paths for auxiliary wheels of the truck, the running paths extending within the whole length of the junction railway, the running paths being arranged, in plan view, so that a predetermined positional relation to the railway rails is maintained according to the track gauge, and being shaped, in elevation view, so that a top surface of the running paths is maintained higher than the top surface of the rails of the junction railway beyond the middle portion so as to release the locking means for the wheels of the truck when the auxiliary wheels are raised by the running paths, both end portions of the running paths being continuously inclined downwards.

6. A ground facility as claimed in claim 5, wherein the height of the running paths is such that a change in height of a center of gravity of the truck passing from the narrower or wider gauge railway to the junction railway is smaller than a difference between the height of the top surface of the running paths and the height of the top surface of the rails of the junction railway at a corresponding location.

7. A ground facility as claimed in claim 6 wherein the height of the running paths and the height of the railway rails at positions side by side with the running paths are such as to maintain constant the height of the center of gravity of the truck passing through the narrower, wider and junction railways.

8. A ground facility as claimed in claim 5 further comprising a pair of inside guide rails which extend beyond the whole length of the running paths within the junction railway and are arranged, in plan view, inside of the pair of railway rails with a predetermined positional relation to the track gauge, and, in elevation view, with a top surface thereof maintained higher than the top surface of the railway rail.

9. A ground facility as claimed in claim 8 wherein the height of the running paths is such that a change in height of a center of gravity of the truck passing from the narrower or wider gauge railway to the junction railway is smaller than a difference between the height of the top surface of the running paths and the height of the top surface of the rails of the junction railway at a corresponding location.

10. A ground facility as claimed in claim 9 wherein the height of the running paths and the height of the railway rails at positions side by side with the running paths are such as to maintain constant the height of the center of gravity of the truck passing through the narrower, wider and junction railways.

11. A ground facility as claimed in claim 5, further comprising a pair of outside guide rails which extend beyond the whole length of the running paths within the junction railway and are arranged, in plan view, outside of the pair of rails with a predetermined positional relation to the track gauge, and, in elevation view, with a top surface thereof maintained higher than the top surface of the railway rail.

12. A ground facility as claimed in claim 11 wherein the height of the running paths is such that a change in height of a center of gravity of the truck passing from the narrower or wider gauge railway to the junction railway is smaller than a difference between the height of the top surface of the running paths and the height of the top surface of the rails of the junction railway at a corresponding location.

13. A ground facility as claimed in claim 12 wherein the height of the running paths and the height of the railway rails at positions side by side with the running paths are such as to maintain constant the height of the center of gravity of the truck passing through the narrower, wider and junction railways.

14. A ground facility as claimed in claim 5, further comprising a pair of inside guide rails which extend beyond the whole length of the running paths within the junction railway and are arranged, in plan view, inside of the pair of rails with a predetermined positional relation to the track gauge, and, in elevation view, with a top surface thereof maintained higher than the top surface of the railway rail, and a pair of outside guide rails which extend beyond the whole length of the running paths within the junction railway and are arranged, in plan view, outside of the pair of rails with a predetermined positional relation to the track gauge, and, in elevation view, with a top surface thereof maintained higher than the top surface of the railway rail.

15. A ground facility as claimed in claim 14 wherein the height of the running paths is such that a change in height of a center of gravity of the truck passing from the narrower or wider gauge railway to the junction railway is smaller than a difference between the height of the top surface of the running paths and the height of the top surface of the rails of the junction railway at a corresponding location.

16. A ground facility as claimed in claim 15 wherein the height of the running paths and the height of the railway rails at positions side by side with the running paths are such as to maintain constant a height of the center of gravity of the truck passing through the narrower, wider and junction railways.

17. A ground facility for changing a wheel-spacing of a truck comprising:

a narrower track gauge railway of a first track gauge, a wider track gauge railway of a second track gauge greater than said first track gauge, a no-rail railway section between said narrower track gauge railway and said wider track gauge railway where no railway rail is arranged, running paths for auxiliary wheels arranged outside of said wider track gauge railway rails in a widthwise direction and extending over a length covering a part of said wider track gauge railway, a part of said narrower track gauge railway and said no-rail railway section in a longitudinal direction, a top surface of the running paths being maintained higher than top surfaces of the railway rails and both end portions of the running paths being continuously inclined downwards, and a pair of inside guide rails extending, within a section of the running paths, from inside the narrower track gauge railway rails to inside the wider track gauge railway rails, a top surface of the inside guide rails being maintained higher than the top surface of the railway rails.

18. A ground facility for changing a wheel-spacing of a truck comprising:

a narrower track gauge railway of a first track gauge, a wider track gauge railway of a second track gauge greater than said first track gauge, a no-rail railway section between said narrower track gauge railway and said wider track gauge railway where no railway rail is arranged, running paths for auxiliary wheels arranged outside of said wider track gauge railway rails in a widthwise direction and extending over a length covering a part of said wider track gauge railway, a part of said narrower track gauge railway and said no-rail railway section in a longitudinal direction, a top surface of the running paths being maintained higher than top surfaces of the railway rails and both end portions of the running paths being continuously inclined downwards, and a pair of outside guide rails extending, within a section of the running paths, from outside the narrower track gauge railway rails to outside the wider track gauge railway rails, a top surface of the outside guide rails being maintained higher than the top surface of the railway rails.

19. A ground facility as claimed in claim 18 further comprising:

a pair of inside guide rails extending within the section of the running path from inside the narrower track gauge railway rails to inside the wider track gauge railway rails, a top surface of the inside guide rails being maintained higher than the top surface of the railway rails.

20. A variable wheel-spacing truck comprising:

a bogie frame having a pair of side beams and a transom extending transversely with respect to the side beams, the transom having first and second opposite ends each secured to one of the side beams;

a front axle and a rear axle connected with one another by the side beams, one of the axles extending between the side beams;

a pair of wheels mounted on the one of the axles slidably relative thereto in a transverse direction of the truck;

axle boxes rotatably supporting the wheels;

axle box receivers supporting the axle boxes;

releasable locking means for fixing the axle boxes to the axle box receivers at a plurality of positions arranged in the transverse direction of the truck; and auxiliary wheels rotatably mounted on the axle box receivers.

21. A variable wheel-spacing truck as claimed in claim 20 wherein at least one of the wheels is allowed to rotate relative to the axle.

22. A variable wheel gauge truck as claimed in claim 20 wherein each wheel is prevented from rotating relative to the axle.

* * * * *